US007798086B2

(12) United States Patent
Ruggaber

(10) Patent No.: US 7,798,086 B2
(45) Date of Patent: Sep. 21, 2010

(54) APPARATUS AND METHOD FOR DOCKING, DEPLOYING AND RECOVERING AN UNDERWATER VEHICLE

(75) Inventor: Willi Ruggaber, Owingen (DE)

(73) Assignee: Diehl BGT Defence GmbH & Co. KG., Ueberlingen (DE)

( * ) Notice: Subject to any disclaimer, the term of this patent is extended or adjusted under 35 U.S.C. 154(b) by 0 days.

(21) Appl. No.: 11/953,090

(22) Filed: Dec. 10, 2007

(65) Prior Publication Data

US 2008/0302292 A1 Dec. 11, 2008

(30) Foreign Application Priority Data

Jun. 11, 2007 (DE) ..... 10 2007 027 403
Jul. 4, 2007 (DE) ..... 10 2007 031 156

(51) Int. Cl.
*B63G 8/00* (2006.01)
*B63G 8/32* (2006.01)
*B63G 8/42* (2006.01)
*B63B 21/56* (2006.01)
*B63B 49/00* (2006.01)

(52) U.S. Cl. ..... 114/238; 114/244; 114/249; 114/258; 114/312; 114/316; 114/322

(58) Field of Classification Search ..... 114/238, 114/239, 244, 249, 253, 254, 258, 259, 312, 114/316–320, 322; 294/19.1, 19.2, 100
See application file for complete search history.

(56) References Cited

U.S. PATENT DOCUMENTS 2,568,210 A * 9/1951 Whitney ..... 294/100
3,647,253 A * 3/1972 Hettinger et al. ..... 294/66.1
3,921,943 A * 11/1975 Munro et al. ..... 244/137.1
3,943,875 A * 3/1976 Sanders ..... 114/244
4,304,189 A * 12/1981 Wright ..... 114/254
4,987,634 A * 1/1991 Weihrauch ..... 15/209.1
5,120,099 A * 6/1992 Fletcher ..... 294/66.1
5,447,115 A * 9/1995 Moody ..... 114/312
6,190,265 B1 * 2/2001 Schmitt ..... 473/286
6,502,527 B1 1/2003 Danielson
6,600,695 B1 7/2003 Nugent et al.
6,883,453 B1 * 4/2005 Mulhern ..... 114/253

FOREIGN PATENT DOCUMENTS

DE 19938914 C1 9/2000
GB 2239632 A * 7/1991
WO WO 2008012473 A1 * 1/2008

* cited by examiner

*Primary Examiner*—Ajay Vasudeva
(74) *Attorney, Agent, or Firm*—Laurence A. Greenberg; Werner H. Stemer; Ralph E. Locher

(57) ABSTRACT

An apparatus for deployment and recovery of an underwater vehicle can be introduced into a recovery tube of an underwater recovery vehicle. The apparatus has a moveable tube provided with an insertion/extraction device at one of its ends. The device is in the form of a tube or of a ring in a retracted state and in the form of a funnel in an extended state. There is also disclosed a method for deployment and a method for recovery of an underwater vehicle by way of the above-mentioned apparatus that is introduced into a recovery tube of an underwater recovery vehicle. Additionally, there is disclosed a method for docking an underwater vehicle at a recovery tube of an underwater recovery vehicle provided with the above-mentioned apparatus.

20 Claims, 3 Drawing Sheets

APPARATUS AND METHOD FOR DOCKING, DEPLOYING AND RECOVERING AN UNDERWATER VEHICLE

CROSS-REFERENCE TO RELATED APPLICATION

This application claims the priority, under 35 U.S.C. §119, of German patent applications DE 10 200 702 7403.5 filed Jun. 11, 2007 and DE 10 200 703 1156.9, filed Jul. 4, 2007; the prior applications are herewith incorporated by reference in their entirety.

BACKGROUND OF THE INVENTION

Field of the Invention

The invention relates to an apparatus for deployment and recovery of an underwater vehicle. The apparatus can be introduced into a recovery tube of an underwater recovery vehicle. The invention also relates to a method for recovery and to a method for deployment of an underwater vehicle having an apparatus such as this, which apparatus is introduced into a recovery tube of an underwater recovery vehicle. The invention additionally relates to a method for docking an underwater vehicle with an apparatus such as this, which apparatus is introduced into a recovery tube of an underwater recovery vehicle.

U.S. Pat. No. 6,502,527 B1 describes, in a general form, the use of unmanned underwater vehicles specifically for reconnaissance missions, both in the research field and in the military field. Some of these missions make it necessary for an underwater vehicle such as this to be recovered by an underwater recovery vehicle, such as a submarine. Particularly when the mission is a covert mission for gathering data or involves a highly costly underwater vehicle, the recovery of the vehicle is of major interest.

There are numerous approaches which could be used to allow the recovery of an underwater vehicle by a submarine. One possibility is to provide an apparatus for recovery of an underwater vehicle on the outer casing of the submarine. However, the aim is to operate the submarine generally as a so-called "covert observer." In order to prevent third parties from being able to locate them easily, the shapes of submarines are generally optimized such that they have a signature which can be located only with great difficulty. If a recovery apparatus were therefore to be fitted retrospectively on the outside of a submarine, thus disadvantageously changing its signature, and/or making it worse, then this effect would be destroyed. Furthermore, fitting of an apparatus such as this would necessitate direct work on a submarine, which generally also involves high costs.

The above-mentioned U.S. Pat. No. 6,502,527 B1 itself discloses a system for the recovery of appliances underwater, for example underwater vehicles. In this case, a recovery component which can be extended and has a gripping arm that can be pivoted out and in at its end is arranged in a recovery tube of an underwater recovery vehicle. This gripping arm can engage in an appliance located underwater, and this can then orient this appliance with respect to a further recovery tube, and then push it into this recovery tube. This has the disadvantage that at least two recovery tubes are required for a recovery process, specifically one for the recovery component and one for the underwater vehicle to be recovered. Furthermore, the two recovery tubes must be arranged with respect to one another such that the gripping arm can also move the underwater vehicle into its recovery tube, which is intended for it.

U.S. Pat. No. 5,447,115 discloses a recovery appliance which comprises a multiplicity of concentric tubes that extend telescopically through a torpedo shaft or tube in a submarine to its outer casing. A recovery vehicle is located within the recovery appliance and is connected to the recovery appliance via a holding cable which can be unwound by means of a winch. In order to recover an underwater vehicle, the recovery vehicle is fired from the recovery appliance, but in this is still connected to the holding cable. The recovery vehicle is then connected via a male coupling piece to a corresponding female mating coupling piece on the underwater vehicle to be recovered. The holding cable is then wound in again, and the underwater vehicle connected to the recovery vehicle is drawn into the torpedo shaft. The concentric tubes of the recovery appliance are moved back further, and the underwater vehicle remains in the torpedo shaft. This recovery concept has the disadvantage that not only a recovery appliance per se but also an extra recovery vehicle for recovery of an underwater vehicle are required. Furthermore, the couplings of the recovery vehicle and the underwater vehicle must be matched to one another in order to allow recovery at all. Furthermore, there is a risk of collisions between the recovery appliance as well as the underwater vehicle with the torpedo shaft during the insertion process, if the recovery appliance is not exactly aligned with the opening of the torpedo shaft. Collisions such as these can lead to damage to the recovery vehicle and to the underwater vehicle, as well as to it being tilted within the torpedo shaft.

BRIEF SUMMARY OF THE INVENTION

The invention is based on the object of specifying an apparatus for deployment and for recovery of an underwater vehicle, which apparatus can be introduced into a recovery tube of an underwater recovery vehicle without necessitating extensive modifications to the recovery tube of an underwater recovery vehicle, and without occupying a large amount of space, either. The invention is also based on the object of specifying both a method for deployment and a method for recovery of an underwater vehicle by means of an apparatus such as this, which apparatus is introduced into a recovery tube of an underwater recovery vehicle, allowing simple and safe deployment and recovery of an underwater vehicle. A further object of the invention is to specify a method for docking an underwater vehicle with the abovementioned apparatus, which apparatus is introduced into a recovery tube of an underwater recovery vehicle, allowing autonomous recovery of an underwater vehicle.

With the above and other objects in view there is provided, in accordance with the invention, an apparatus for deployment and recovery of an underwater vehicle, wherein the apparatus is configured for introduction into a recovery tube of an underwater recovery vehicle, the apparatus comprising:

a. a moveable tube having a first end;

b. an insertion/extraction device disposed at the first end of the moveable tube, the insertion/extraction device taking the form of a tube or of a ring in a retracted state thereof and taking the form of a funnel in an extended state.

In other words, the objects relating to the apparatus are achieved according to the invention by an apparatus of the type mentioned initially in that the apparatus has a movable tube which is provided with an insertion/extraction device at one of its ends which means is in the form of a tube or of a ring in a retracted state, and is in the form of a funnel in an extended state.

In the present case, the expression "moveable tube" means that either the tube as a single entity or at least parts of it can be moved or shifted.

The invention is based on the knowledge that an apparatus which is introduced into a recovery tube for recovery of an underwater vehicle does not involve costly work on an underwater recovery vehicle, in particular such as a submarine, since vehicles such as these generally have a multiplicity of tubes—for example in the form of torpedo tubes—which are suitable for recovery. The invention is also based on the knowledge that underwater vehicles which are used, for example, for reconnaissance purposes, in general have dimensions which allow introduction without any problems into a tube which, for example, has only a slightly smaller internal diameter than a torpedo tube that is used as a recovery tube.

In a next step, the invention is based on the knowledge that the essentially completely tubular configuration of the apparatus—specifically a tube and insertion/extraction device in the form of a tube or of a ring in the retracted state or in the form of a funnel in the extended state—means that the apparatus not only allows the underwater vehicle to pass through it during a deployment process or a recovery process, but also allows the underwater vehicle to be stored within the apparatus. This space-saving configuration of the apparatus, which also makes optimum use of the space available within a recovery tube, therefore makes it possible for the apparatus and the underwater vehicle to be recovered to occupy only one common recovery tube in an underwater recovery vehicle. The other recovery tubes in an underwater recovery vehicle are therefore available for other purposes, for example for being fitted with torpedoes or being fitted with further apparatuses for deployment and recovery of underwater vehicles, or to be available for underwater vehicles to be directly fitted in them themselves. The tubular configuration of the apparatus also makes it possible for an underwater vehicle such as a heavyweight torpedo to be loaded in the recovery tube. Furthermore, it is also possible for an underwater vehicle to still be connected via an "umbilical cord" in the form of a glass fiber cable to the underwater recovery vehicle in order to interchange data while carrying out its mission, because the end of the tube of the apparatus is open in the direction of the interior of the underwater recovery vehicle. This allows real-time data interchange between the underwater recovery vehicle and the underwater vehicle during its mission. This is therefore a "man-in-the-loop" concept which makes it possible for an operator onboard the underwater recovery vehicle to modify or even to terminate the underwater vehicle mission at short notice, for example when there is a threat risk to it, for example by transmitting appropriate commands via the glass fiber cable. In addition, it is possible to provide for the underwater vehicle to be connected to an interface with the underwater recovery vehicle by means of a cable, for example an electrical cable, before its deployment or after its recovery, when it is stored in the tube, in order to allow information about the overall status of the underwater vehicle to be read via this interface. The underwater vehicle itself has an appropriate interface for this purpose of course, to which the cable mentioned above can be connected.

In a further step, the invention is based on the knowledge that, depending on the extent of the retracted or extended state of the insertion/extraction device, an underwater vehicle may be surrounded in a fixed form by the underwater vehicle along its circumference thus allowing the underwater vehicle to be gripped and guided. This means that the insertion/extraction device can carry out a function like that of pliers. Furthermore, the invention is based on the knowledge that the funnel-shaped configuration of the insertion/extraction device likewise allows passive guidance of the underwater vehicle both during its deployment and its recovery to be achieved, without damaging the inlet or outlet area of the recovery tube. Particularly when an underwater vehicle is being "threaded" into the insertion/extraction device, this provides a certain error tolerance for offsets of the underwater vehicle from the optimum alignment with respect to the apparatus, because of the funnel shape.

The invention is also based on the idea that, when a submarine is being operated as an underwater recovery vehicle an underwater vehicle can be tilted in the area, which is always flooded with water, between the pressure body and the outer casing of the submarine, while the underwater vehicle is being moved into or out of or torpedo tube that has been used as a recovery tube, since there are always supporting struts passing through this area between the pressure body and the outer casing. However, the movable tube of the apparatus, through which the underwater vehicle can be moved or in which the underwater vehicle can be stored, results in a guide bead being provided which prevents such tilting or even, in the worst case, the underwater vehicle falling into this area, since this area is covered by appropriate movement of the apparatus through the tube. This ensures that, for example when the apparatus is being used to deploy the underwater vehicle, the tail or the rear area of the underwater vehicle is located in the open-water or free-water area outside the outer casing of the underwater recovery vehicle during the final phase, and not in the area that is flooded with water between the pressure body and the outer casing.

The apparatus, with its substantially tubular configuration, therefore allows underwater recovery vehicles which have a recovery tube to be retrofitted in a simple manner without any need for costly or complex modification measures to the underwater recovery vehicle or to the recovery tube. The apparatus can simply be inserted into a recovery tube. Furthermore, this apparatus makes it possible for underwater vehicles to be deployed and recovered autonomously without any need for the assistance of an operator onboard the underwater recovery vehicle. Autonomous docking of an underwater vehicle with an apparatus such as this is also feasible.

In practice, the tube of the apparatus is formed from a plurality of tube sections which can be pushed out of and into one another telescopically. The tube sections may be in the form of tube pieces with different external and internal diameters, which are connected to one another such that, in the state when they are pushed one inside the other, the tube piece with the smallest external diameter is located on the inside, and is surrounded by the tube pieces whose internal diameter is larger. The length of the tube can therefore be changed easily by pushing the tube sections out of one another telescopically. For example, this allows the length of the tube to be matched to the length of an underwater vehicle to be recovered, so that an underwater vehicle which is located within the tube is protected by the tube against damage from the outside over its entire length. Furthermore, after a recovery process has been completed, the length of the tube can then, for example, be reduced again sufficiently to allow the tube to be stored behind a pressure bulkhead in a torpedo tube in a submarine. When an underwater vehicle is then intended to be deployed again, the pressure bulkhead can be opened, and the tubes can once again be pushed out of one another until they extend to a muzzle shutter which is located in the outer casing of a submarine.

The insertion/extraction device for the apparatus is preferably designed such that in the extended state, it has a larger circumference than the tube at the end facing away from the tube and, in the retracted state, has a circumference which corresponds to or is smaller than the tube. This configuration makes it possible for an underwater vehicle to pass the insertion/extraction device without any problems by appropriate matching of its circumference, and to be stored in the tube. This configuration also allows the apparatus to be stored or stowed completely and including the insertion/extraction device within a recovery tube, thus preventing any change to the signature of an underwater recovery vehicle whose signature is optimized by appropriate shaping. In addition, the insertion/extraction device exerts a certain amount of force on an underwater vehicle that is stored in the tubes if, in the retracted state, its circumference is smaller than the tube and, in particular, is smaller than the maximum circumference of the underwater vehicle, restraining the underwater vehicle in the area of the tube and therefore preventing unintentional loss of the underwater vehicle.

The insertion/extraction device is expediently designed such that its opening at the end facing away from the tube is increased during extension and is reduced during retraction. This makes it possible for an underwater vehicle which has moved into the funnel of the extended insertion/extraction device to be surrounded by the insertion/extraction device along its circumference when the insertion/extraction device is subsequently retracted, that is to say the insertion/extraction device can exert a function like pliers on the underwater vehicle. Subsequent movement of the tube in the direction of the interior of the underwater recovery vehicle thus allows the underwater vehicle to be safely transported into the recovery tube without any need to be concerned about damage to the underwater vehicle resulting from it colliding with the outer casing of the underwater recovery vehicle or with the recovery tube itself. In contrast, before deployment of the underwater vehicle, it can initially at first be firmly surrounded by the insertion/extraction device and can then be drawn out of its "clasps" as soon at least the insertion/extraction device is located in the open water outside the outer casing for the underwater vehicle.

In one preferred refinement of the invention, the insertion/extraction device is provided with one or more alignment means. In the present case, the expression alignment means should be understood as aiming means, so-called "homing devices". In this case, it is assumed that underwater vehicles entrusted with a mission in general have reconnaissance means in the form of detection apparatuses for electromagnetic radiation, acoustic signals etc.—for example in the form of sonars, cameras with different spectral ranges, radar devices. An underwater vehicle which has appropriate detection apparatuses that respond to the alignment means can use the detected signal of the alignment means for more exact alignment with the funnel of the insertion/extraction device. This makes it possible to keep any risk of damage to the underwater vehicle during the recovery process low.

It is particularly advantageous to use not just one but a plurality of alignment means. This ensures that the underwater vehicle can still be aligned with the insertion/extraction device even if one of the alignment means were to fail. Furthermore, the use of a plurality of alignment means in fact ensures that the underwater vehicle can detect a signal of the alignment means, depending on the direction in which an underwater vehicle is approaching a recovery tube.

The alignment means is or are preferably acoustic, optical and/or magnetic alignment means. If acoustic alignment means are used, this may be a so-called "pinger." Pingers are acoustic signal transmitters. Since underwater vehicles for reconnaissance purposes generally have a sonar for position-finding and measurement, they can locate the pinger and finely align their orientation with respect to the insertion/extraction device. A pinger also makes it possible for an underwater vehicle to align itself with the insertion/extraction device at a very early stage, since its signal can also be perceived at long range, for example at a range of 100 m, by an underwater vehicle that is equipped with a sonar. An optical alignment means may, for example, be a laser, in particular a green laser. A green laser has the advantage that its spectral line has very long range in water—ranges in the region of 10 meters or more can be achieved even in cloudy water. Since, if an underwater vehicle is equipped appropriately, laser radiation can be detected very precisely by an adequate optical detector, this also allows particularly exact alignment of the underwater vehicle with the insertion/extraction device. Depending on the position of the laser light spot arriving at the radiation-sensitive surface of a detector, the offset of the underwater vehicle with respect to the position of the point of origin of the laser radiation, that is to say the alignment means, can be determined and corrected from this by means of appropriate electronics. Magnetic alignment means may, for example, be coils through which a current flows, causing magnetic induction in coils which are provided for this purpose and are fitted in the underwater vehicle. The underwater vehicle can likewise be aligned with the insertion/extraction device.

It is, of course, feasible to use different types of alignment means in combination with one another, for example a combination of optical, acoustic and magnetic alignment means. This makes it possible to ensure that different types of underwater vehicles which, for example, can detect an evaluate only signals from an optical, acoustic or magnetic alignment means and not all three different signals, also have the capability to recorrect their position on the basis of a signal originating from a specific type of alignment means.

It is advantageous for the alignment means to be arranged on that edge of the insertion/extraction device which is located at the end facing away from the tube. This means that, when the insertion/extraction device are extended and the alignment means is activated, the underwater vehicle is aligned with the insertion/extraction device with the underwater vehicle still being at a certain "safety distance" from the underwater recovery vehicle, thus making it possible to avoid a collision with the outer casing of the underwater recovery vehicle or with the insertion/extraction device. Furthermore, this arrangement at the edge provides the underwater vehicle with spatial information relating to the area of the opening of the funnel-shaped insertion/extraction device.

It is particularly advantageous for the alignment means to be arranged at mutually equidistant intervals on that edge of the insertion/extraction device which faces away from the tube. This makes it possible to align the underwater vehicle particularly exactly with the insertion/extraction device, because the underwater vehicle can use the alignment means arranged in this way to obtain an impression, by means of its appropriate detection apparatuses, of the spatial orientation and the size of the opening of the insertion/extraction device, and its own position and attitude with respect to these means.

The tube preferably has a length of more than 3 meters. Since the distance between the outer casing and the pressure body of modern submarines which are used as underwater recovery vehicles is generally 3 meters, a tube with a length of more than 3 meters allows this intermediate space to be completely bridged by the tube, for example by the tube being introduced into this immediate space by movement. The tube through which the underwater vehicle can move or in which it is stored therefore offers protection against the underwater vehicle becoming tilted in this intermediate space during its deployment or its recovery, or even falling into this intermediate space.

In practice, the tube is manufactured from carbon-fiber-reinforced plastic. Carbon-fiber-reinforced plastic has the advantage that its own weight is lighter than that of metallic materials. The use of this plastic makes it possible to keep the weight load of an underwater recovery vehicle low. This is particularly important, for example, when submarines are used as underwater recovery vehicles, since, in this case, attention must be paid to having a low weight load in order not to adversely affect the manoeuvrability of the submarine. It is, of course, also feasible to use other lightweight composite materials as the material for the tube.

It is also useful for the tube to be manufactured from a non-magnetic material. Non-magnetic materials have the advantage that they cannot be located by magnetic fields. This makes it possible to provide protection against magnetic sensors, for example mines. It is therefore also impossible for the apparatus to be located by, for example, submarines with a hostile intent, by means of a magnetic field.

The insertion/extraction device can expediently be extended by means of struts, which are provided with joints, to form a funnel-shaped basket. The strut structure allows the material required and thus the weight load on an underwater recovery vehicle resulting from the apparatus to be kept low. The joints allow the insertion/extraction device to have an insertion and extraction capability in the form of an umbrella, thus allowing the insertion/extraction device to be stowed particularly well within a recovery tube. Furthermore, the strut structure allows the effect of the insertion/extraction device in the form of pliers to be implemented particularly well.

In practice, the struts are connected at their end which faces away from the tube via joints to further struts which are connected to one another via joints and which, when the insertion/extraction device is extended, form the edge of the basket. As has already been described, the strut structure makes it possible to keep the material required and thus the weight load on an underwater recovery vehicle caused by the apparatus low. Once again, the joints allow the insertion/extraction device to be stowed well. Furthermore, the struts can be used for fitting of the alignment means. The electrical supply lines to the alignment means may be routed, for example, along or within the struts.

With the above and other objects in view there is also provided, in accordance with the invention, a method for the recovery of an underwater vehicle having an abovementioned apparatus, which has been introduced into a recovery tube of an underwater recovery vehicle. The method comprises the following steps:

a) movement of the tube in the direction of the open water and extension of the insertion/extraction device such that at least the insertion/extraction device is located outside an outer casing of the underwater recovery vehicle;

b) once the underwater vehicle is at least partially located within the funnel of the insertion/extraction device, the insertion/extraction device is retracted until that edge of the insertion/extraction device at the end facing away from the tube surrounds the circumference of the underwater vehicle such that the underwater vehicle can be introduced into the recovery tube by movement of the tube; and c) insertion of the underwater vehicle into the recovery tube by movement of the tube in the direction of the interior of the underwater recovery vehicle.

In the present case, the expression open water means the area outside an underwater recovery vehicle.

The invention is based on the knowledge that the movement of the tube according to method step a) allow the insertion/extraction device to be extended completely, that is to say the funnel can be deployed and can open to its full size. This allows an underwater vehicle to be "threaded" into the apparatus more easily, since the underwater vehicle is guided by the funnel shape of the insertion/ extraction device as soon as it enters the opening area of the insertion/extraction device. The obvious approach is for the "nose" of an underwater vehicle to enter the funnel during a recovery process such as this.

The invention is furthermore based on the knowledge that the use of the insertion/extraction device to surround the underwater vehicle once it has at least partially moved into the funnel of the insertion/extraction device prevents accidental loss of the underwater vehicle and makes it possible to shutdown the propulsion system for the underwater vehicle even in this movement state. Furthermore, this means that there is no longer any need for further alignment by the underwater vehicle in its own right with the recovery tube. The underwater vehicle is deliberately surrounded in its front area by the insertion/extraction device in order as early as possible to prevent possible damage to the underwater vehicle by any subsequent collision with the insertion/extraction device or the tube. The underwater vehicle propulsion system can then be switched on again if the underwater vehicle is intended to be introduced even further into the area of the tube, for example for storage purposes, and has been released again by the insertion/extraction device.

This method therefore allows an underwater vehicle to be recovered safely and without damage, since it is possible to prevent collisions with the recovery tube or outer casing of the underwater recovery vehicle. Furthermore, autonomous recovery is feasible and there is no need for an operator to carry out the steps manually or to monitor the recovery process.

In practice, the method step of activation of the alignment means is also carried out before method step b). This allows not only passive guidance of the underwater vehicle into the apparatus via the insertion/extraction device in the form of a funnel, but also active guidance by alignment by the underwater vehicle itself with the apparatus, by the underwater vehicle detecting the signals from the alignment means, and appropriately aligning itself with them.

With the above and other objects in view there is also provided, in accordance with the invention, a method for the deploying an underwater vehicle having an abovementioned apparatus, which has been introduced into a recovery tube of an underwater recovery vehicle. The method comprises the following steps:

a) the insertion/extraction device surrounds the circumference of the underwater vehicle;

b) the tube is moved together with the underwater vehicle in the direction of open water such that the insertion/extraction device is located outside an outer casing of the underwater recovery vehicle; and c) the insertion/extraction device is opened by further extension of the insertion/extraction device until the underwater vehicle is no longer surrounded by the insertion/extraction device.

The invention is based on the knowledge that the surrounding of the circumference of the underwater vehicle according to method step a) and the movement of the tube together with the underwater vehicle according to method step b) allow deliberate deployment of an underwater vehicle in a manner that prevents damage to the underwater vehicle within the recovery tube, and any possible loss of it. Furthermore, the invention is based on the knowledge that opening of the insertion/extraction device according to method step c) furthermore ensures a certain amount of passive guidance of the underwater vehicle on leaving the apparatus, by virtue of its funnel shape. An underwater vehicle which has been recovered using a recovery method as described above would therefore move backwards out of the apparatus while carrying out the deployment method as described above, that is to say with the tail first. Before the underwater vehicle can be surrounded by the insertion/extraction device according to method step a), it must, of course, enter the area inside the insertion/extraction device. This can be done by the underwater vehicle itself, for example using its own propulsion system.

With the above and other objects in view there is also provided, in accordance with the invention, a method for the docking an underwater vehicle having an abovementioned apparatus, which has been introduced into a recovery tube of an underwater recovery vehicle. The method comprises the following steps:

a) the underwater vehicle approaches rendezvous coordinates which have been agreed between the underwater vehicle and the underwater recovery vehicle;

b) an identification interchange is carried out between the underwater vehicle and the underwater recovery vehicle;

c) if the identification interchange is successful, approach to the recovery tube; and d) the underwater vehicle is at least partially inserted into the funnel of the extended insertion/extraction device of the apparatus.

The invention is based on the idea that an underwater vehicle and an underwater recovery vehicle often carry out different missions at different locations. For this reason, it is worthwhile for an underwater vehicle which is intended to be recovered again to approach rendezvous coordinates, which have been agreed with the underwater recovery vehicle, after successful completion of its mission. These rendezvous coordinates may be coordinates which have already been agreed between the underwater vehicle and the underwater recovery vehicle before the start of the mission, or which have been agreed between the underwater vehicle and the underwater recovery vehicle during the mission. Data such as this can be interchanged between the underwater vehicle and the underwater recovery vehicle for example via a data link in the form of an optical waveguide or glass-fiber cable, which remain connected to the underwater vehicle and the underwater recovery vehicle during its mission. By way of example, data can be transmitted in both directions via a glass-fiber cable for this purpose. The real-time data transmission therefore makes it possible to provide a "man-in-the-loop" concept which allows an operator onboard on the underwater recovery vehicle to modify or even terminate the mission of the underwater vehicle at short notice if, for example, there is a threat risk to it, by transmitting appropriate commands via the glass fiber cable. In addition, it may be worthwhile agreeing not only rendezvous coordinates but also a time at which such a rendezvous should take place, in the same way. This makes it possible to avoid, for example, long waiting or dead times for the underwater recovery vehicle and underwater vehicle.

Furthermore, the invention is based on the idea that it is not only possible for the underwater recovery vehicle that is intended to carry out the recovery process to be located underwater but also for enemy underwater recovery vehicles to be underway, whose intent is to destroy the underwater vehicle or to use it for its for own purposes. For this reason, it is worthwhile for the underwater vehicle to interchange data with the underwater recovery vehicle in order to allow identification of whether this is the "correct" underwater recovery vehicle, in the sense of being friendly.

The present method makes it possible for an underwater vehicle to completely autonomously approach, and to be recovered by, an underwater recovery vehicle and an apparatus that is fitted in a recovery tube for its recovery, without any need for further actions by an operator on board an underwater recovery vehicle. A so-called rendezvous takes place between the underwater vehicle and the underwater recovery vehicle in order to receive the underwater vehicle in the recovery tube of an underwater recovery vehicle. First of all, the underwater vehicle approaches the expected area for the rendezvous. At the same time, the underwater recovery vehicle approaches the rendezvous coordinates, that is to say the position agreed between the two of them, on a fixed track, with the underwater recovery vehicle moving in a horizontal straight line at minimum speed there, and effectively hovering for a certain time interval. This "hovering" has the advantage that the insertion/extraction device no longer changes the position of its funnel, that is to say the funnel does not rotate and the underwater vehicle effectively "sees" a stationary funnel. The underwater vehicle approaches the underwater recovery vehicle on the opposite track, and starts the process of automatic docking with the apparatus which has been introduced into the recovery tube of the underwater recovery vehicle.

The method step of determining a current position of the underwater vehicle by way of a GPS receiver located in the underwater vehicle is expediently carried out before method step a). Underwater recovery vehicles—such as a submarine—generally have a very good navigation system, which means that is it possible to approach agreed rendezvous coordinates very precisely. Since, however, underwater vehicles often have to take care to ensure that their weight is not too heavy and also that certain dimensions are not exceeded, they are generally not equipped with a similarly good navigation system, but in general have only inertial sensors in order to determine their own position. Higher-performance underwater vehicles can also have an echo sounder in the form of a Doppler velocity log and/or a TERCOM system ("terrain contour matching" system) in order to improve the accuracy with which their own position is found. However, since underwater vehicles often have a GPS receiver, it may be worthwhile for an underwater vehicle to carry out a position update on its current position via its GPS receiver—before it approaches the agreed rendezvous coordinates. The underwater vehicle must surface to do this. It can then approach the agreed rendezvous coordinates with greater accuracy by virtue of the fact that it now accurately knows its current position. This makes it possible to avoid the underwater recovery vehicle and the underwater vehicle waiting for one another, in the worst case, futilely, at different locations.

It is particularly practical for the method step of the underwater vehicle approaching on the broad side of the underwater recovery vehicle to be carried out before the abovementioned method step b). This is because an approach on the broadside makes it possible for both the underwater vehicle and the underwater recovery vehicle to orientate themselves with a respectively detected signature to determine whether this is "friend" or "foe". Both underwater vehicles and underwater recovery vehicles generally have sonar systems which allow such signature detection. Since the detectable outline by means of a sonar system is greater when approaching the broadside, it is more clearly possible to distinguish whether this is "friend" or "foe". It is worthwhile continuing the process only if "friend" is identified. Otherwise, an underwater vehicle will no longer initiate the other method steps.

It is also advantageous to carry out the method steps of a) detection of the alignment means by the underwater vehicle, and b) orientation of the underwater vehicle on the basis of the detected alignment means before the abovementioned method step d). This allows the underwater vehicle to recorrect its position with respect to the insertion/extraction device, in order to avoid any damage in the final phase of the docking process—for example caused by collision with the outer boundaries of the insertion/extraction device or the outer casing of the underwater recovery vehicle. The underwater vehicle is then steered autonomously into the funnel-shaped insertion/extraction device, and can then be recovered by it, by means of its own detection and evaluation apparatus for the alignment means, for example in the form of an optical seeker head.

Other features which are considered as characteristic for the invention are set forth in the appended claims.

Although the invention is illustrated and described herein as embodied in apparatus and method for deployment and recovery of an underwater vehicle, and method for docking an underwater vehicle with an apparatus such as this, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTIONS OF THE SEVERAL VIEWS OF THE DRAWING

The same or functionally corresponding parts are identified with the same reference symbols throughout.

DETAILED DESCRIPTION OF THE INVENTION

Figure 1:
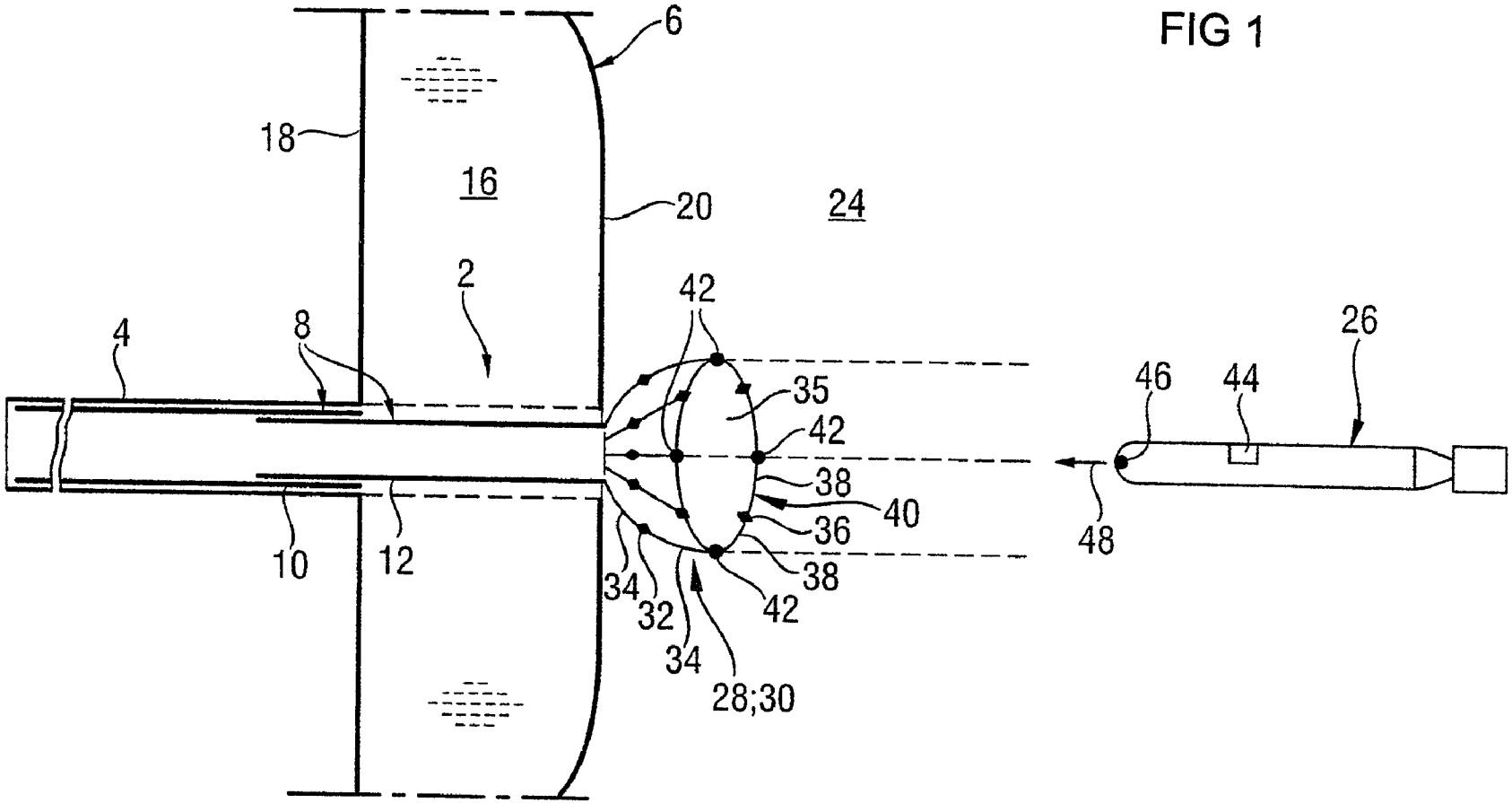
FIG. 1 is a schematic section through an apparatus, which has been introduced into an underwater recovery vehicle, for deployment and recovery of an underwater vehicle.

Referring now to the figures of the drawing in detail, FIG. 1, schematically, a section through an apparatus 2 which has been introduced into a recovery tube, in the present case a torpedo tube 4, of an underwater recovery vehicle, in the present case a submarine 6. The apparatus 2 has a moveable tube 8 which is composed of tube sections which can be moved telescopically in one another in the form of tube pieces 10, 12. The tube 8 is manufactured from carbon-fiber-reinforced plastic. The tube piece 10 of the tube 8 has a length of about 6 meters, that is to say it corresponds to the length of a conventional modern torpedo tube. The tube piece 12 has a length of more than 3 meters, so that this can bridge the intermediate space 16, which is always flooded with water, between the pressure body 18 and the outer casing 20 of a typical submarine 6, in order to guide an underwater vehicle 26. An insertion/extraction device 28 in the form of a basket 30, which is funnel-shaped when in the extended state, is fitted to that end of the tube 8 which faces the free-water area 24. Both the tube 8 and the tube pieces 10, 12 as well as the insertion/extraction device 28 can be moved or extended/retracted by means of drives that are not illustrated. In the present case, spindle drives with a linkage are used. The basket 30 is formed by struts 34 provided with joints 32. This means that it is possible to make the opening 35 of the insertion/extraction device 28 larger or smaller, in the form of an umbrella. The struts 34 themselves are connected to further struts 38, which are connected to one another via joints 36. The struts 38 form an edge 40 on which four alignment means 42 are arranged. The alignment means 42, which in the present case are pingers, acoustic signal transmitters, are distributed at uniform intervals over the edge 40, as can clearly be seen in FIG. 1. The underwater vehicle to be recovered and which is in the form of a so-called AUV—"autonomous underwater vehicle"—26, is located in the free-water area 24 opposite the insertion/extraction device. The underwater vehicle 26 is equipped with a GPS receiver 44. Before the underwater vehicle 26 approached the rendezvous coordinates agreed with the submarine 6, it used its GPS receiver 44 to update its current position by surfacing on the surface of the water, in order to allow it to approach the rendezvous coordinates as accurately as possible. In order to carry out a successful identification interchange with the submarine 6, the underwater vehicle 26 has approached the submarine 6 from the broad side. Since the identification interchange was successful, the tube 8 was moved for recovery of the underwater vehicle such that the basket 30 could be completely deployed in the free-water area 24. Furthermore, the alignment means 42 were activated. The underwater vehicle 26 is also equipped with a detection apparatus in the form of a sonar 46, in order to evaluate the signals from the pinger. In consequence, the underwater vehicle can then align itself more accurately with the centre of the opening 35 in the insertion/extraction device 28, and can then move into the basket 30 in the direction of the arrow 48. As soon as the underwater vehicle 26 is at least partially located within the basket 30, the basket 30 is contracted, with its edge 40 surrounding the underwater vehicle 26 in the form of pliers. The already partially retracted basket 30 is now drawn into the torpedo tube 4 with the underwater vehicle 26 "trapped" in it, by moving the tube piece 12 into the tube piece 10. The basket 30 is then opened somewhat again, so that the underwater vehicle can be moved completely, with its nose area in front, into the tube 8.

Figure 2:
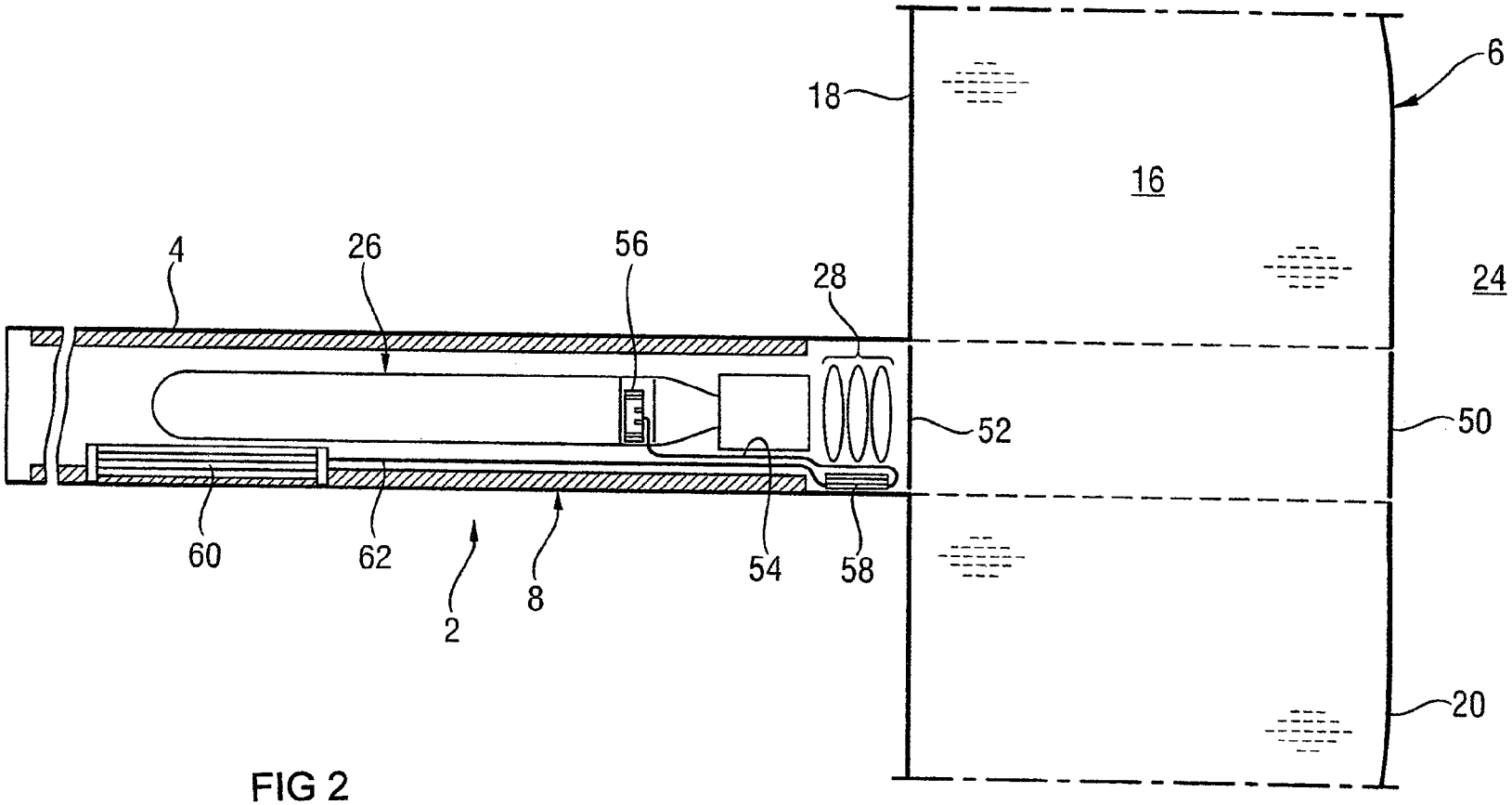
FIG. 2 is a sectional view of an apparatus according to the invention, mounted in a recovery tube, and an underwater vehicle located in it.

FIG. 2 now shows an apparatus 2 which is mounted in a recovery tube that is in the form of a torpedo tube 4 and is illustrated in a simplified form, and an underwater vehicle 26 located in this apparatus 2. FIG. 2 illustrates the final scenario of a successfully completed recovery process of the underwater vehicle 26 by the apparatus 2 illustrated schematically in FIG. 1. The underwater vehicle 26 is already located completely within the torpedo tube 4. It has successfully passed through the intermediate space 16 that is flooded with water, through the tube 8. The muzzle shutter 50, which is provided in the outer casing 20 of the submarine 6, is already closed, as is the pressure bulkhead 52 in the area of the pressure body, sealing the torpedo tube 4. As can be seen from FIG. 2, the apparatus 2 has been stowed in a space-saving manner, the insertion/extraction device 28 has been retracted in the form of a tube, so that it can be stowed without any problems behind the tail of the underwater vehicle 26. As can also be seen from FIG. 2, the underwater vehicle 26 is connected to the submarine via an optical waveguide in the form of a glass fiber 54. Data is interchanged via the glass fiber 54 between the submarine 6 and the underwater vehicle 26, for example for an identification interchange, for agreement of the rendezvous coordinates or for transmission of data gathered by the underwater vehicle 26 during its mission. In order to allow such an interchange of data to be carried out over long distances, a plurality of glass fiber coils 56, 58 and a winch 60 are provided. The glass fiber coil 56 is located in the wet hull section of the underwater vehicle 26. The glass fiber coil 58, which is mounted in the torpedo tube 4, is drawn along by the underwater vehicle 26 during its deployment and at the start of its mission, and is used as a form of extension cable or intermediate station when the underwater vehicle 26 is travelling over long distances. A towing cable 62, which may be a flexible tube in which a glass fiber is guided and which has a length of between 20 and 30 m can be retrieved again after completion of the mission of the underwater vehicle 26, by means of the winch 60 that is located in the torpedo tube 4. At the end of the mission, the glass fiber coil 58 is not itself recovered again, and the glass fiber 54 which has been unwound from the glass fiber coil 56 is also cut off by means of a blade located in the area of the glass fiber coil 56, and is not used again. The glass fiber coil 56 is replaced before a new mission, and a new glass fiber coil 58 is introduced into the torpedo tube 4. The underwater vehicle 26 which is stored in the apparatus 2 can be deployed by means of the apparatus 2, which is shown in FIG. 2 and is stowed in the torpedo tube 4, by opening the pressure bulkhead 52 and the muzzle shutter 50. Part of the underwater vehicle 26 then moves into the insertion/extraction device 28, and is firmly surrounded by its edge 40 along its circumference. The tube piece 12 and thus also the insertion/extraction device 28 and the underwater vehicle 26 are now moved telescopically such that the insertion/extraction device can open outside the outer casing 20 of the submarine 6 sufficiently to allow the underwater vehicle 26 to move out of the basket 30. The underwater vehicle 26 then leaves the funnel-shaped area of the basket 30, by moving backwards out of it.

Figure 3:
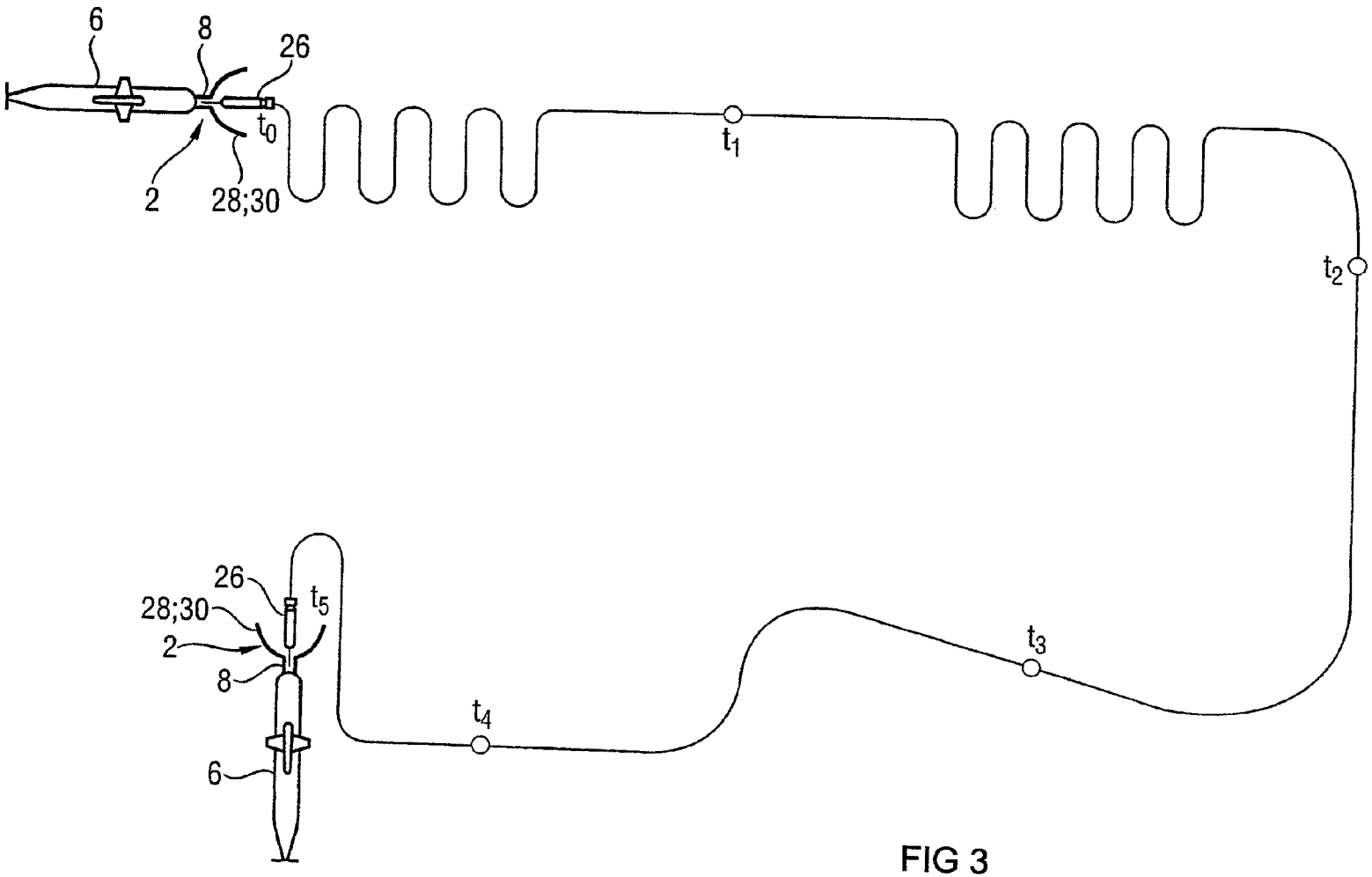
FIG. 3 is a schematic view illustrating the phases of a mission of an underwater vehicle from deployment through docking to its recovery.

FIG. 3 shows, schematically, the chronological phases of a mission of an underwater vehicle 26 from its deployment, through its docking to its recovery. The apparatus 2 which is provided on a submarine 6 is in this case indicated only in a simplified form, with a tube 8 and an insertion/extraction device 28 and a basket 30. As described above, the underwater vehicle 26 is deployed via the apparatus 2 at the time to. This illustration shows how the insertion/extraction device 28 has already opened again sufficiently to allow the underwater vehicle 26 to move backwards out of it. During the times $t_1$, $t_2$, $t_3$ of its mission, the underwater vehicle 26 transmits, for example, data gathered by it via its data link in the form of the glass fiber 54 and by means of a modern to the submarine 6, receives modified mission data—such as modified rendezvous coordinates—from the submarine 6 and obtains a position update of its current position by means of its GPS receiver 44. At the time $t_4$, the underwater vehicle 26 has already approached the rendezvous coordinates agreed with the submarine 6 and has approached it from the broadside in order to use the signature of the submarine 6 to determine whether this is the submarine 6 that is intended to recover it. It now carries out an identification interchange in order to unambiguously identify whether this is the "correct" submarine 6. Once this has been successfully verified by the underwater vehicle 26, its starts its docking process with the apparatus 2, which has been moved by the submarine 6 to the position required for recovery, once it itself has successfully carried out the identification interchange. At the time $t_5$, the underwater vehicle 26 has already moved partially into the basket 30, and is now recovered by the apparatus 2, as already described above.

The invention claimed is:

1. An apparatus for deployment and recovery of an underwater vehicle to and from a recovery tube of an underwater recovery vehicle, the apparatus comprising:

a moveable tube having a first end sized to be received into the recovery tube of the underwater recovery vehicle, said moveable tube being slidably disposed within the recovery tube;

an insertion/extraction device disposed at said first end of said moveable tube, said insertion/extraction device being a tube or a ring in a retracted state thereof and being a funnel in an extended state thereof; and said insertion/extraction device being configured to have an end facing away from said moveable tube with greater circumference than said moveable tube in the extended state, and a circumference that corresponds to or is smaller than said moveable tube in the retracted state thereof.

2. The apparatus according to claim 1, wherein said insertion/extraction device has an opening at the end facing away from said moveable tube, said opening increasing during extension and decreasing during retraction.

3. The apparatus according to claim 1, wherein said moveable tube has a length of more than 3 m.

4. The apparatus according to claim 1, wherein said moveable tube is carbon-fiber-reinforced plastic.

5. The apparatus according to claim 1, wherein said apparatus has a substantially complete tubular configuration.

6. An apparatus for deployment and recovery of an underwater vehicle to and from a recovery tube of an underwater recovery vehicle, the apparatus comprising:

a moveable tube having a first end sized to be received into the recovery tube of the underwater recovery vehicle;

an insertion/extraction device disposed at said first end of said moveable tube, said insertion/extraction device being a tube or a ring in a retracted state thereof and being a funnel in an extended state thereof;

said insertion/extraction device being configured to have an end facing away from said moveable tube with greater circumference than said moveable tube in the extended state, and a circumference that corresponds to or is smaller than said moveable tube in the retracted state thereof; and said moveable tube including a plurality of tube sections configured to telescope into and out of one another.

7. An apparatus for deployment and recovery of an underwater vehicle to and from a recovery tube of an underwater recovery vehicle, the apparatus comprising:

a moveable tube having a first end sized to be received into the recovery tube of the underwater recovery vehicle;

an insertion/extraction device disposed at said first end of said moveable tube, said insertion/extraction device being a tube or a ring in a retracted state thereof and being a funnel in an extended state thereof; and said insertion/extraction device including one or more alignment means disposed on said funnel in the extended state thereof.

8. The apparatus according to claim 7, wherein said alignment means are one or more devices selected from the group consisting of acoustic devices, optical devices, and magnetic devices.

9. An apparatus for deployment and recovery of an underwater vehicle to and from a recovery tube of an underwater recovery vehicle, the apparatus comprising:

a moveable tube having a first end sized to be received into the recovery tube of the underwater recovery vehicle;

an insertion/extraction device disposed at said first end of said moveable tube, said insertion/extraction device being a tube or a ring in a retracted state thereof and being a funnel in an extended state thereof;

said insertion/extraction device including one or more alignment means; and said alignment means being disposed on an edge of said insertion/extraction device at an end thereof facing away from said moveable tube.

10. The apparatus according to claim 9, wherein said alignment means are disposed at mutually equidistant intervals on said edge of said insertion/extraction device at the end facing away from said moveable tube.

11. A method of recovering an underwater vehicle, the method which comprises the following steps:

providing an underwater recovery vehicle with an apparatus having a moveable tube with a first end being introduced into a recovery tube of the underwater recovery vehicle; and an insertion/extraction device disposed at said first end of said moveable tube, said insertion/extraction device being a tube or a ring in a retracted state thereof and being a funnel in an extended state thereof, and thereafter carrying out the following steps:

a) moving the moveable tube in a direction of open water and extending the insertion/extraction device, to locate at least the insertion/extraction device with a funnel outside an outer casing of the underwater recovery vehicle;

b) retracting, after the underwater vehicle is at least partially located within the funnel of the insertion/extraction device, the insertion/extraction device until an edge of the insertion/extraction device at the end facing away from the moveable tube grips a periphery of the underwater vehicle and introducing the underwater vehicle into the recovery tube by moving the moveable tube; and c) moving the moveable tube in a direction of an interior of the underwater recovery vehicle inserting the underwater vehicle into the recovery tube.

12. The method according to claim 11, which further comprises activating an alignment prior to method step b).

13. A method of deploying an underwater vehicle, the method which comprises the following steps:

providing an underwater recovery vehicle with an apparatus having a moveable tube with a first end being introduced into a recovery tube of the underwater recovery vehicle; and an insertion/extraction device disposed at said first end of said moveable tube, said insertion/extraction device being a tube or a ring in a retracted state thereof and being a funnel in an extended state thereof, and thereafter carrying out the following steps:

a) enclosing a periphery of the underwater vehicle with insertion/extraction means;

b) moving the moveable tube together with the underwater vehicle in a direction of open water to place the insertion/extraction device outside an outer casing of the underwater recovery vehicle; and c) opening the insertion/extraction device by further extending the insertion/extraction device until the underwater vehicle is no longer surrounded by the insertion/extraction device.

14. A method of docking an underwater vehicle at an underwater recovery vehicle, the method which comprises:

providing the underwater recovery vehicle with a recovery apparatus having a moveable tube with a first end being introduced into a recovery tube of the underwater recovery vehicle; and an insertion/extraction device disposed at said first end of said moveable tube, said insertion/extraction device being a tube or a ring in a retracted state thereof and being a funnel in an extended state thereof, and carrying out the following steps:

a) approaching, with the underwater vehicle, rendezvous coordinates that have been agreed between the underwater vehicle and the underwater recovery vehicle;

b) carrying out an identification interchange between the underwater vehicle and the underwater recovery vehicle;

c) if the identification interchange is successful, approaching towards the recovery tube; and d) at least partially inserting the underwater vehicle into a funnel formed by the extended insertion/extraction device of the apparatus.

15. The method according to claim 14, which further comprises:

prior to step a), determining a current position of the underwater vehicle by way of a GPS receiver located in the underwater vehicle.

16. The method according to claim 14, which comprises:

prior to step b), approaching a broad side of the underwater recovery vehicle with the underwater vehicle.

17. The method according to claim 14, which comprises, before carrying out the step of at least partially inserting the underwater vehicle:

detecting alignment of the underwater vehicle; and orienting the underwater vehicle on the basis of the detected alignment.

18. An apparatus for deployment and recovery of an underwater vehicle to and from a recovery tube of an underwater recovery vehicle, the apparatus comprising:

a moveable tube having a first end sized to be received into the recovery tube of the underwater recovery vehicle;

an insertion/extraction device disposed at said first end of said moveable tube, said insertion/extraction device being a tube or a ring in a retracted state thereof and being a funnel in an extended state thereof, said insertion/extraction device being configured to have an end facing away from said moveable tube with greater circumference than said moveable tube in the extended state, and a circumference that corresponds to or is smaller than said moveable tube in the retracted state thereof; and at least one alignment device being arranged on an edge of said insertion/extraction device which is located at the end facing away from said moveable tube.

19. The apparatus of claim 18, wherein said at least one alignment device is one or more devices selected from the group consisting of acoustic devices, optical devices, and magnetic devices.

20. An apparatus for deployment and recovery of an underwater vehicle to and from a recovery tube of an underwater recovery vehicle, the apparatus comprising:

a moveable tube having a first end sized to be received into the recovery tube of the underwater recovery vehicle; and an insertion/extraction device disposed at said first end of said moveable tube, said insertion/extraction device being a tube or a ring in a retracted state thereof and having extendable jointed struts to form a funnel in an extended state thereof, said struts having ends facing away from said moveable tube being connected via joints to further struts, and said further struts being connected to one another via joints to form an edge of said funnel when said insertion/extraction device is extended.

* * * * *